US006017018A

United States Patent [19]

Langdon

[11] Patent Number: 6,017,018

[45] Date of Patent: Jan. 25, 2000

[54] LIFT-A-TOP PLUS

[76] Inventor: Steven Michael Langdon, 90640 Link Rd., Eugene, Oreg. 97402

[21] Appl. No.: 09/032,874

[22] Filed: Mar. 2, 1998

[51] Int. Cl.[7] ..... B66F 7/26

[52] U.S. Cl. ..... 254/47; 254/127

[58] Field of Search ..... 254/4 R, 4 B, 254/4 C, 8 R, 8 B, 8 C, 47, 48, 124, 127, 128, 134, DIG. 4

[56] References Cited

U.S. PATENT DOCUMENTS

| | | | |
|---|---|---|---|
| 3,738,517 | 6/1973 | Luse . | |
| 3,743,125 | 7/1973 | Ashley, Jr. . | |
| 3,758,074 | 9/1973 | Jeffries et al. . | |
| 3,841,603 | 10/1974 | Lund et al. | 254/47 |
| 3,868,088 | 2/1975 | Reeves . | |
| 3,931,957 | 1/1976 | Thibodeaux | 254/127 |
| 4,497,469 | 2/1985 | Barnhouse | 254/8 B |
| 4,600,177 | 7/1986 | Fritz | 254/47 |

*Primary Examiner*—Robert C. Watson
*Attorney, Agent, or Firm*—Patent Trademark Services; Thomas Zack; Joseph H. McGlynn

[57] ABSTRACT

An apparatus used to lift and lower an object, such as a canopy covering placed on a truck's opened bed. A T-shaped load engaging platform member has a vertically adjustable sleeve mounted on the platform's vertical member whose position on the member can be adjusted and fixed along its height. A combined winch and cable controlled pivoted arm assembly having two joined pivotally arms, one of which arms is pivotally mounted to a vertical stationary support structure at its other end, is used to vertically support the engaging platform member above the ground at the end opposite the stationary support. A single operator can both raise and lower a load supported on the platform by rotating a handle on the winch assembly and directing the movement of the supported load.

6 Claims, 2 Drawing Sheets

A
A

LIFT-A-TOP PLUS

BACKGROUND OF THE INVENTION

Lifting a heavy bulky object, such as the covering canopy for an opened bed truck, is typically a two or three person job. Apparatuses employing push rods, lifting jacks, pivoted legs, cables and other mechanical devices have been used to assistant a user in lifting and positioning the canopy or camper body on or off the opened truck bed on which it normally resides when in place. Some such apparatus are external to the canopy to be moved while others are built-in to part of the existing canopy. In the present invention the lifting apparatus is mounted to the interior upper surface of the existing canopy roof and an external rigid vertical support structure such that a single operator can easy guide and lift the canopy either into place on the truck or remove the same from the truck all as detailed hereafter.

DESCRIPTION OF THE PRIOR ART

Different types of apparatuses used to lift/remove truck canopies or camper units are known. For example, in U.S. Pat. No. 3,738,517 to Luse pairs of camper mounted push rods are used in conjunction with guide means are used to mount or dismount the camper from the truck's opened bed.

In U.S. Pat. No. 3,743,125 to Ashley, Jr. a pair of pivoted legs is mounted on each side of the camper body and pivotally attached to a ground support member at their lower ends. A diagonal cable attached to the legs along with a lateral cable attached to the ground support assist in this process.

The Jeffries et al. invention (U.S. Pat. No. 3,758,074) discloses removable jack lifters with telescoping tubular sections mounted to comer plates on the camper body. And in U.S. Pat. No. 3,868,088 to Reeves tiltable stanchion-type jacks with lower bifurcated ground engaging feet are described. A telescoping front stanchion subassembly having an adjustable shock absorber may also be used in the same invention. In the present invention a vertically adjustable support sleeve attached to a T-shaped canopy roof engaging member is supported by a pivoted arm assembly whose arm motion is controlled by a cable operated winch as more further set forth in this specification.

SUMMARY OF THE INVENTION

This invention relates to an apparatus used to lift and lower an object, such as a canopy place on an opened truck bed. A T-shaped object engaging member has a vertically adjustable sleeve member mounted on the member while a rigid cable controlled pivoted arm assembly attached to a vertical support structure is used to vertically support the engaging member above the ground.

It is the primary object of the present invention to provide for an improved object lifting and lowering apparatus.

Another object is to provide for such an apparatus used to lift and lower a canopy from an opened truck bed.

These and other objects and advantages of the present invention will become apparent to readers from a consideration of the ensuing description and the accompanying drawings.

DESCRIPTION OF THE PREFERRED EMBODIMENT

Figures 1, 3, 4, 5:
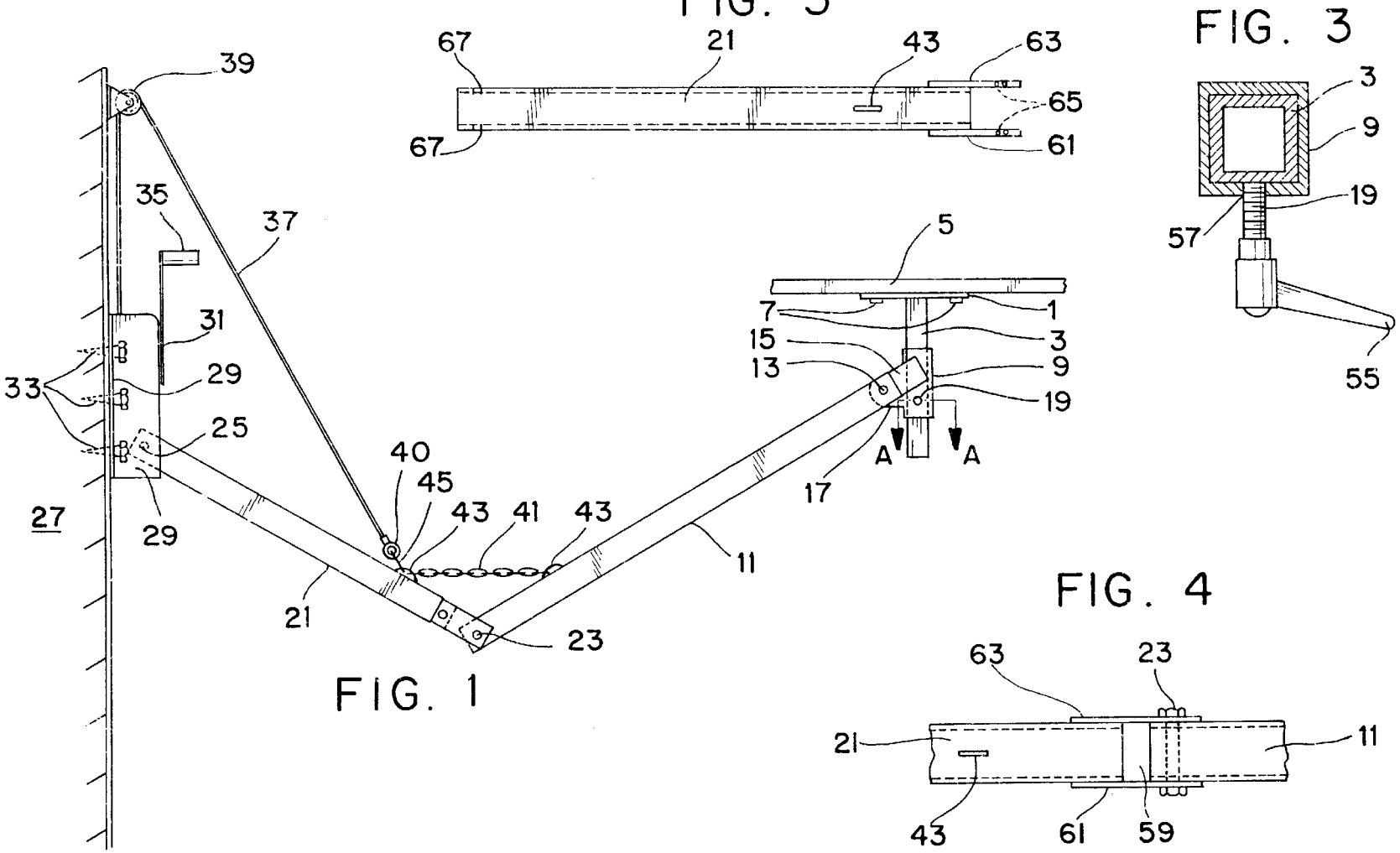
FIG. 1 is a side view of the invention's preferred embodiment.
FIG. 3 shows a cross sectional view of the vertical support and adjustable sleeve taken along lines A—A of FIG. 1 with a handle set screw.
FIG. 4 shows a top view of the bolt joint used to attach the arm segments to each other.
FIG. 5 shows a top view of one of the arm members.

FIG. 1 is a side view of the invention's preferred embodiment. A flat metallic plate 1 forms the horizontally disposed member of a T-shaped vertical support platform member. The vertical metallic member 3 is rigidly attached to the center of plate 1 and forms the other part of the T-shaped vertical support platform member. Above the flat relatively thin plate 1 there is shown a larger surface area flat surface 5 made of plywood or the like held by screws or bolts 7 to the lower plate 1. The use of the upper surface 5 extended area surface is optional and is used to engage the surface of the object to be lifted or lower, as appropriate. In the absence of this optional larger surface area support member 5, the metal plate 1 itself, without any inserted screws/bolts, can be used to engage the surface of the object to be moved.

Concentrically slidably mounted on the platform's vertical support member 3 is a movable or adjustable hollow metal sleeve 9 having inside defining dimensions that allow it to slide up or down on the vertical member 3. The FIG. 3 cross sectional view taken along lines A—A of FIG. 1 looking down better depicts this engagement of the square sleeve 9 and the square sectioned vertical support member 3. One end of the elongated metallic arm segment 11 has a bolt 13 used to pivotally attach metallic arm extension 15 which extends towards the sleeve 9. Extension 15 fits around two opposite sides of the sleeve and is fixed thereto by welding or the like By loosening and tightening bolt 13, the angular relationship between the straight arm 11 and the extension 15 with the sleeve 9 fixed to the extension may be changed to accommodate different surfaces to be engaged by the platform's plate 1.

A lower wedge shaped stop plate member 7, forming part of the extension 15, protrudes from the extension's portion aligned with the sides of arm 11 and this plate is used to bear against the side of the sleeve 9 to provide additional side support thereto. After being adjusted along its length, the sleeve 9 is held to the vertical support member 3 by an adjustable set screw 19 shown in more detail in FIG. 3.

Pivotally mounted to arm 11 at the end opposite sleeve 9 is the metallic straight arm member 21. The bolt 23 pivotal engagement of these two straight arms segments is shown in more detail in FIG. 4. The upper or other end of arm member 21 is also pivotally mounted by a second end bolt 25 to a vertical support structure 27 via an extension member 29 located behind the winch member 31 and fixed to the support structure. Member 29 can be a right angled bracket screwed or bolted at its vertical arm into the vertical support structure 27 by several (three shown) screws 33. The vertical support structure 27 may be a stud in the wall of a garage, a sturdy stand alone post embedded into the ground or any other convenient strong upright structure that will not move and which can easily vertically support the weight of the object to be lifted and the components of the invention shown in FIG. 1.

Attached to the bracket member 29 is the hand operated conventional cable winch 31 having one operating rotatable handle 35. Extending from and forming part of the winch assembly is the metal cable 37 which is fixed to the bracket member 29 at one end and runs around the pulley 39. The pulley 39 is in turn fixed to the upper portion of stationary vertical support 27. At the cable's other end extending towards arm 21, a closed looped end 40 is attached and linked via a short cable member 45 to the arm segment 21. An arm restraining closed linked chain 41 has one of its loop ends fitted through the closed link 43 fixed to arm segment 11. A similar arm attached link 43 fixed to arm segment 21 engages and holds the cable's loop end 40 to this arm joined by the short intermediate t cable member 45.

Figure 2:
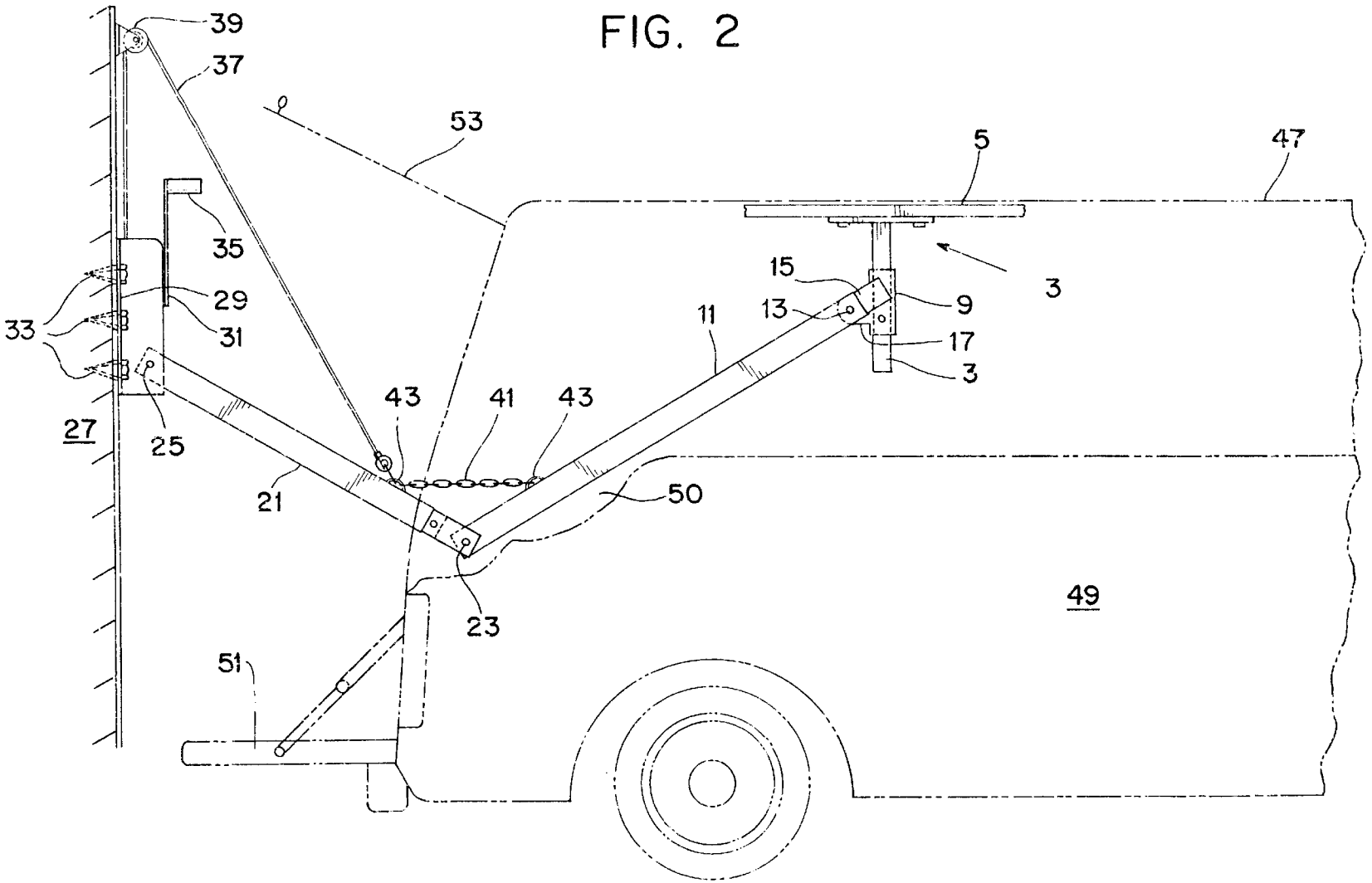
FIG. 2 is a side view of the FIG. 1 embodiment as typically installed to lift or lower a canopy from an opened truck bed.

FIG. 2 is a side view of the FIG. 1 embodiment as it would typically be used to install or lower a protective canopy 47 from an opened bed truck 49 whose rear portion is shown. The term "canopy" as used herein designates any type of removable covering that can be used to cover a portion of the normally opened part of a vehicle including, but not limited to, a camper top covering or a cover for the top open bed of a pickup truck. The canopy 47 is shown as transparent in this figure and a side rear section 50 of the truck's rear end has been cut away so that the invention may be better shown extending from the opened bed to the roof of the canopy. After bolt 13 and set screw 19 are properly adjusted, the optional upper flat surface 5 engages and fits flush against the interior roof surface of the canopy. By using the larger surface area of surface 5 rather than just the smaller surface area support plate 1, the weight of the engaged load or canopy is distributed over a larger surface area thereby reducing the possibility that the canopy will be damaged when moved. Using a larger load engaging platform surface also permits larger loads to be engaged without the possibility of becoming unbalanced. For lightweight plastic shell canopies such as used with campers, etc. using a larger engaged surface platform area is desirable to insure there will be no damage to the supported load and the load will not slid off the load platform.

As the T-shaped load support platform is adjusted by the set screw 19 and the bolt 13, there is some tension on the supporting cable 37, the link chain 41 is somewhat taut and the truck's tailgate 51 and the canopy's tailgate 53 are in opened positions. The tension on the cable and its chain insures the T-shaped elevated support will remain in place against the member 5 and canopy roof while the operator's rotates the winch's handle 35 to apply more tension to the attached cable 37.

As more and more tension is applied the two pivotally attached arms 11 and 21 they will attempt to assume a horizontally disposed position but will be restrained from doing so by the arms' attached chain 41. There is, however, sufficient displacement of the arms towards the horizontal direction (i.e., pivot joint 23 moving upward as shown by the arrow in FIG. 2), to lift the unattached canopy from its resting position over the opened bed of truck 49. Once, this occurs the vertically supported suspended canopy can be removed from the truck or the other vehicle by simply driving the truck forward away from its original canopy supporting position under the canopy.

To lower the elevated and vertically supported canopy, the operator simply rotates the winch's handle 35 in a direction opposite that used to elevate the canopy. When this happens less tension is applied to the cable and the weight of the supported load, here the canopy, can be used to pivot the arms 21 and 11 at their pivot joints 23 and 25 to permit the gent lowering of the load. Thus, both the lifting and lowering of the supported load can easily be accomplished by a single operator by controlling the tension on the cable as the suspended load is moved by hand to a desired position.

FIG. 3 shows a cross sectional view of the vertical support 3 and adjustable sleeve 9 taken along lines A—A of FIG. 1 with a handle set screw. The handle 55 used to engage set screw 19 has been added this figure (i.e., it is not shown in FIG. 1) to indicate how an operator would turn screw1 19. Set screw 19 extends through an internally threaded through hole 57 in the generally square in cross section sleeve 9 until the end of the screw bears against the outer surface of the similar shaped vertical support member 3. By sliding the sleeve up or down the support 3 and then tightening the side set screw 19 these two members can be fixed at a given relationship with respect to each other. Both rigid support metallic arms 11 and 21 have similar square cross sections over all of their straight lengths excepts for their end portions as described.

FIG. 4 shows a top view of the pivotal bolt joint 23 used to attach the lower end of arm 11 to the arm 21. A slight air gap 59 is formed by the two side extensions 61 and 63 fixed to the joining portion of arm 11. A through hole 65 goes through both of the far ends of the two side arm extensions 61 and 63 and the end of arm 11 to provide for the insertion of the joining pivot bolt 13. The attachment closed link 43 fixed to the upper surface of arm 21 is visible in this view while the identical closed link 43 fixed to the upper part of arm 11 is not visible.

FIG. 5 shows a top view of the arm member 21. The two side extensions 61 and 63 are shown again as well as their end through hole 65. At the arm's other end their is another through hole 67 used to insert the pivot bolt 25 when it engages a hole (not shown) in the support bracket 29.

In one embodiment the described invention had the following measurements: length of arm 11 with extension 15, 45 inches; length of arm 21 with its extension 33 inches; outside dimensions of square side for both arms 2.5 inches; top plate 1, 10 inches square with four through holes 1 inch inset from each comer; length of sleeve 9, 6 inches with a 1.25 inch side and a 60 degree angular offset from the straight joining offset extension 15; and length of vertical support 3, 14.25 inches jointed on center to plate 1. Other dimensions for the individual components are of course possible depending on the load's size and weight to be lifted and moved as well as its desired disposition over the ground.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An apparatus for moving a load comprising:

a first rigid arm and a second rigid arm pivotally attached to each other at one end, said arms also being joined together by a motion restraining member to limit their pivotal motion with respect to each other;

an adjustable load support platform assembly pivotally attached to said second arm at the arm's end opposite to where attached to said first arm;

a vertically disposed stationary support structure to which said first arm is pivotally attached to near the arm's end opposite to where attached to said second arm;

a pulley mounted on said vertically disposed stationary support with a cable extending over the pulley; and a winch assembly including a hand operated handle used to move the cable extending over said pulley, said cable being attached to said stationary support at one end and said first arm near where it joins to the second arm at the cable's other end whereby movement of the assembly's handle in one direction will move the arm engaged end of said first arm upward until restrained by the restraining member with respect to joined end of said second arm to form a vertical support for the load supported on the platform assembly.

2. The apparatus as claimed in claim 1, wherein said motion restraining member is a chain attached to both arms at its ends near where the arms are pivotally attached.

3. The apparatus as claimed in claim 2, wherein said adjustable load support platform assembly includes a vertically disposed member with joined load supporting flat horizontally disposed member, said assembly also including a sleeve slidably mounted on said vertically disposed member whose position thereon may be fixed by an engaging member.

4. The apparatus as claimed in claim 3, wherein said load to be moved is a canopy housing that fits over a portion of a motor vehicle, said housing being engaged by the horizontally disposed member of said platform assembly when moved.

5. The apparatus as claimed in claim 4, wherein said first and second arms are substantially square in cross section and made of metal.

6. The apparatus as claimed in claim 5, also including an additional flat plate attached to the upper surface of said platform's horizontally disposed member, said additional flat plate having a load engageable surface area substantially greater than load engaging surface area of the horizontally disposed member.

* * * * *